US006481260B2

(12) United States Patent
Jung

(10) Patent No.: US 6,481,260 B2
(45) Date of Patent: Nov. 19, 2002

(54) DEVICE FOR EMBOSSING METAL PIPE

(75) Inventor: Jong Hyun Jung, Seoul (KR)

(73) Assignee: Senergreen Co., Ltd., Kyonggi-Do (KR)

( * ) Notice: Subject to any disclaimer, the term of this patent is extended or adjusted under 35 U.S.C. 154(b) by 0 days.

(21) Appl. No.: 09/821,408

(22) Filed: Mar. 29, 2001

(65) Prior Publication Data

US 2002/0000114 A1 Jan. 3, 2002

(30) Foreign Application Priority Data

Mar. 29, 2000 (KR) ..... 00-16311
Feb. 28, 2001 (KR) ..... 01-10374

(51) Int. Cl.[7] ..... B21D 31/04
(52) U.S. Cl. ..... 72/353.4; 72/370.04; 72/403
(58) Field of Search ..... 72/75, 117, 343, 72/352, 353.2, 353.4, 353.6, 370.01, 370.04, 393, 403

(56) References Cited

U.S. PATENT DOCUMENTS 465,957 A * 12/1891 Willmott ..... 72/393
1,727,918 A * 9/1929 Ziegler ..... 72/75
2,963,069 A * 12/1960 Pasternak ..... 72/353.4
3,934,443 A * 1/1976 Keen ..... 72/75

* cited by examiner

*Primary Examiner*—Lowell A. Larson
(74) *Attorney, Agent, or Firm*—Marshall, Gerstein & Borun

(57) ABSTRACT

A device for embossing metal pipe is disclosed. The device includes a core having a plunger hole and a plurality of core pass through holes perpendicular to the plunger hole. The device also includes a plunger for moving through the plunger hole to push the punches in the core pass through holes selectively away in a direction perpendicular to the axis of the core.

8 Claims, 13 Drawing Sheets

DEVICE FOR EMBOSSING METAL PIPE

BACKGROUND OF THE INVENTION

1. Field of the Invention

The present invention relates to formation of a metal pipe, and more particularly, to a device for embossing a specific form on a circumferential surface of completed metal pipe.

2. Background of the Related Art

In general, the commercially available metal pipe is used for guiding transportation of various liquids and gases, or as components of various structures. That is, the metal pipe has lots of applications, such as steps in architectural structures, handrail and supports in a building, various guide rails, door grips, frames of various structures (ladders and chairs, and etc.) and the like, for which development of peripheral technologies that facilitate secondary processing of the metal pipe to suit applications is required. Particularly, the embossed metal pipe is advantageous in a variety of aspect, as embossed metal pipe applied to a step of an architectural structure enhances friction to prevent slipping, that permits to secure a safety, and the embossed pipe applied to various hand grips or frames prevents slipping, stimulates palm sensitivity and provides a variety of design features.

However, there has been no device for embossing metal pipe developed up to now, but is embossed merely by using a roll mold to form a plurality of recesses in a circumferential surface of the metal pipe, which is in most cases not suitable for a desired application. Or alternatively, a sheet of metal may be embossed and rolled to form a cylinder. However, in this case too, the embossing is liable to be flattened during the rolling, to form defects in the embossing, and a linear gap formed by the opposite ends of the sheet after the rolling impedes use of the pipe as a fluid guide pipe as far as the gap is not seamed, makes an a poor outer appearance, and is dangerous for use as various hand grip.

SUMMARY OF THE INVENTION

Accordingly, the present invention is directed to a device for embossing metal pipe that substantially obviates one or more of the problems due to limitations and disadvantages of the related art.

An object of the present invention is to provide a device for embossing metal pipe, which can emboss on a circumferential surface of completed metal pipe with easy.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for embossing metal pipe including a frame supported on ground, a length of core having one end detachably fixed horizontally to an upper surface of the frame having a plunger hole at a center thereof in an axis direction and a plurality of core pass through holes perpendicular to the plunger hole in a portion of the core, a first stock fixed to one side of the upper surface of the frame, first reciprocating members fixed in the first stock and the frame each for reciprocating perpendicular to the axis of the core, first segments respectively fitted to insides of the first reciprocating members for moving along the movement of the first reciprocating members, casings detachably and respectively fitted to the segments for coming into a close contact with the core as the casings move inward or moving away from the core as the casings move outward, having a plurality of casing pass through holes in an inside surface thereof opposite to the core pass through holes, a punch movably inserted in each of the core pass through holes for selectively and forcibly moving outwardly perpendicular to the core axis, to form embossing projections on the metal pipe inserted on the core, punch fall off preventing means for keeping the punch in position inside of the core pass through hole without falling off inward or outward direction, a second stock mounted on the other side of the upper surface of the frame, a second reciprocating member fixed to the second stock for reciprocating in the axis direction of the core, a second segment fitted an inside of the second reciprocating member for moving along the movement of the second reciprocating member, and a plunger detachably fixed to the second segment for moving along the movement of the second segment through the plunger hole to push the punches in the core pass through holes selectively away in a direction perpendicular to the axis of the core.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
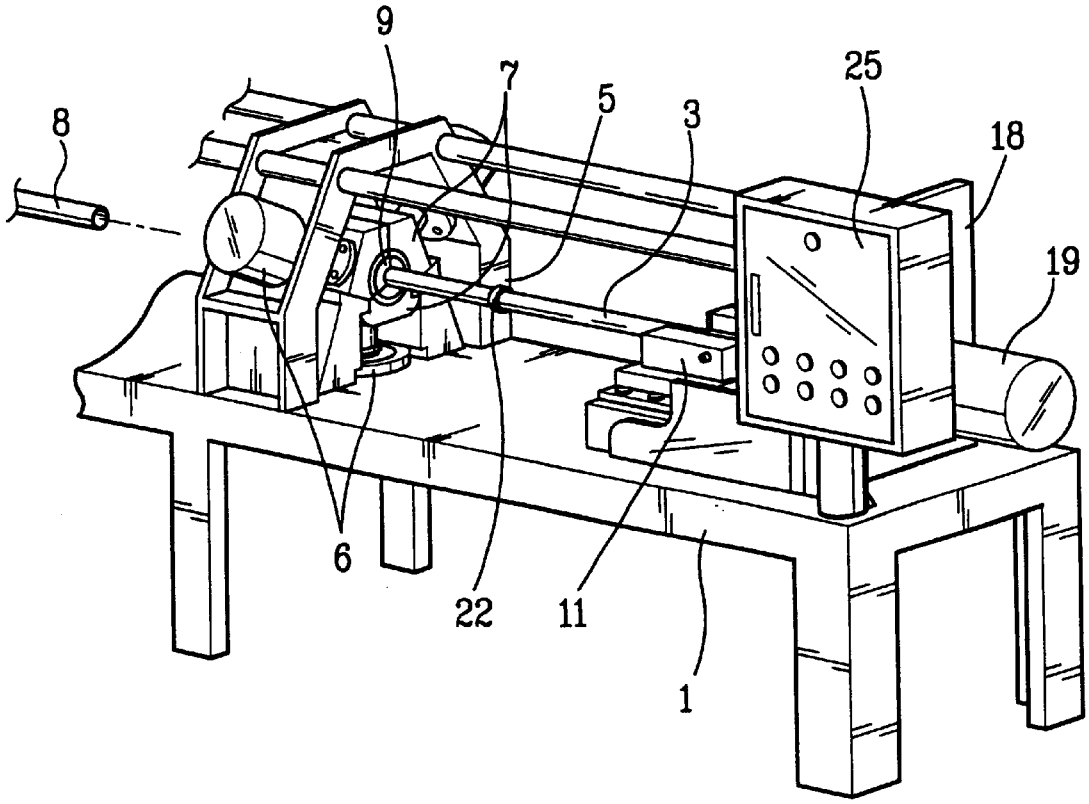
FIG. 1 illustrates a perspective view of a device for embossing metal pipe in accordance with a preferred embodiment of the present invention.
Figure 2:
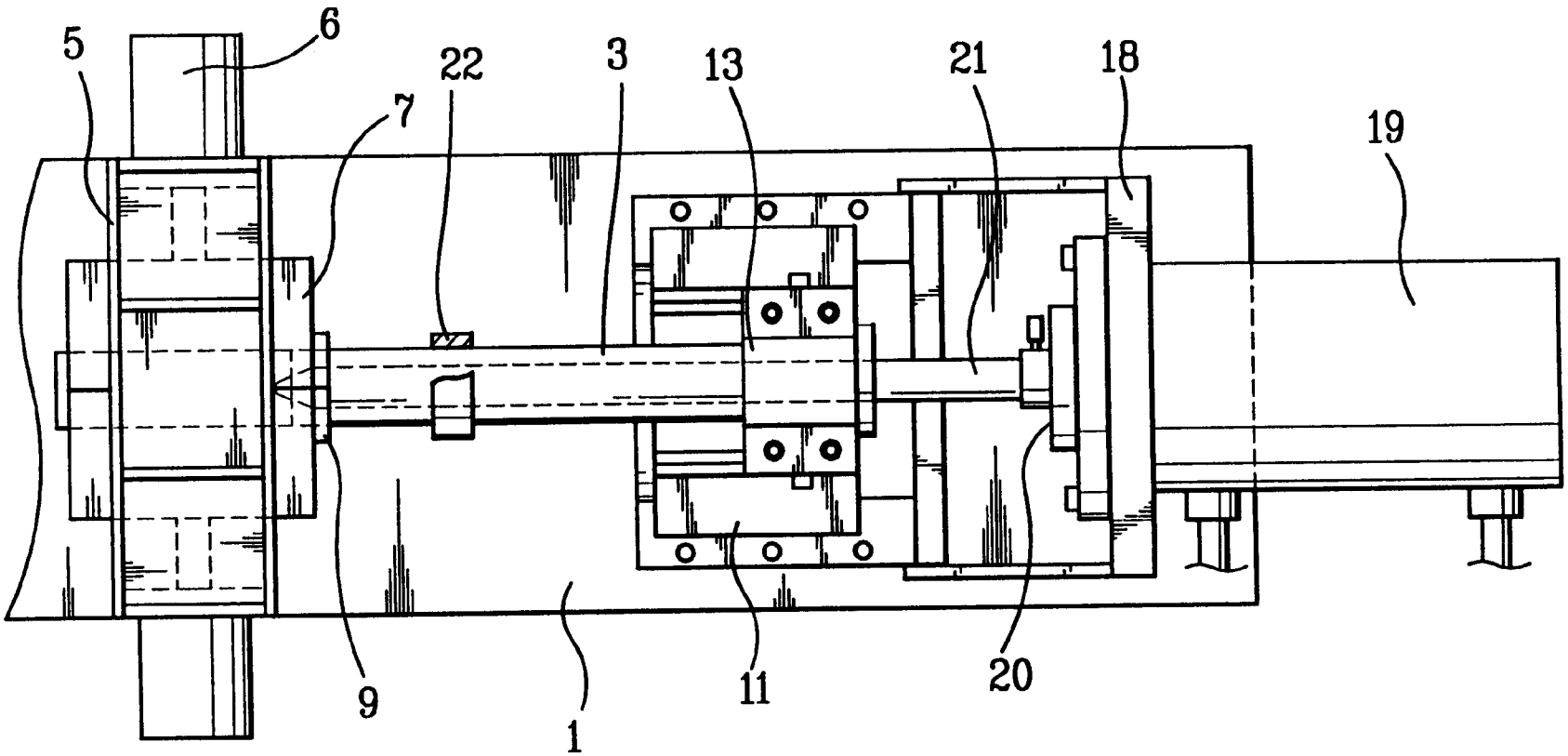
FIG. 2 illustrates a plan view of a device for embossing metal pipe in accordance with a preferred embodiment of the present invention.
Figure 3:
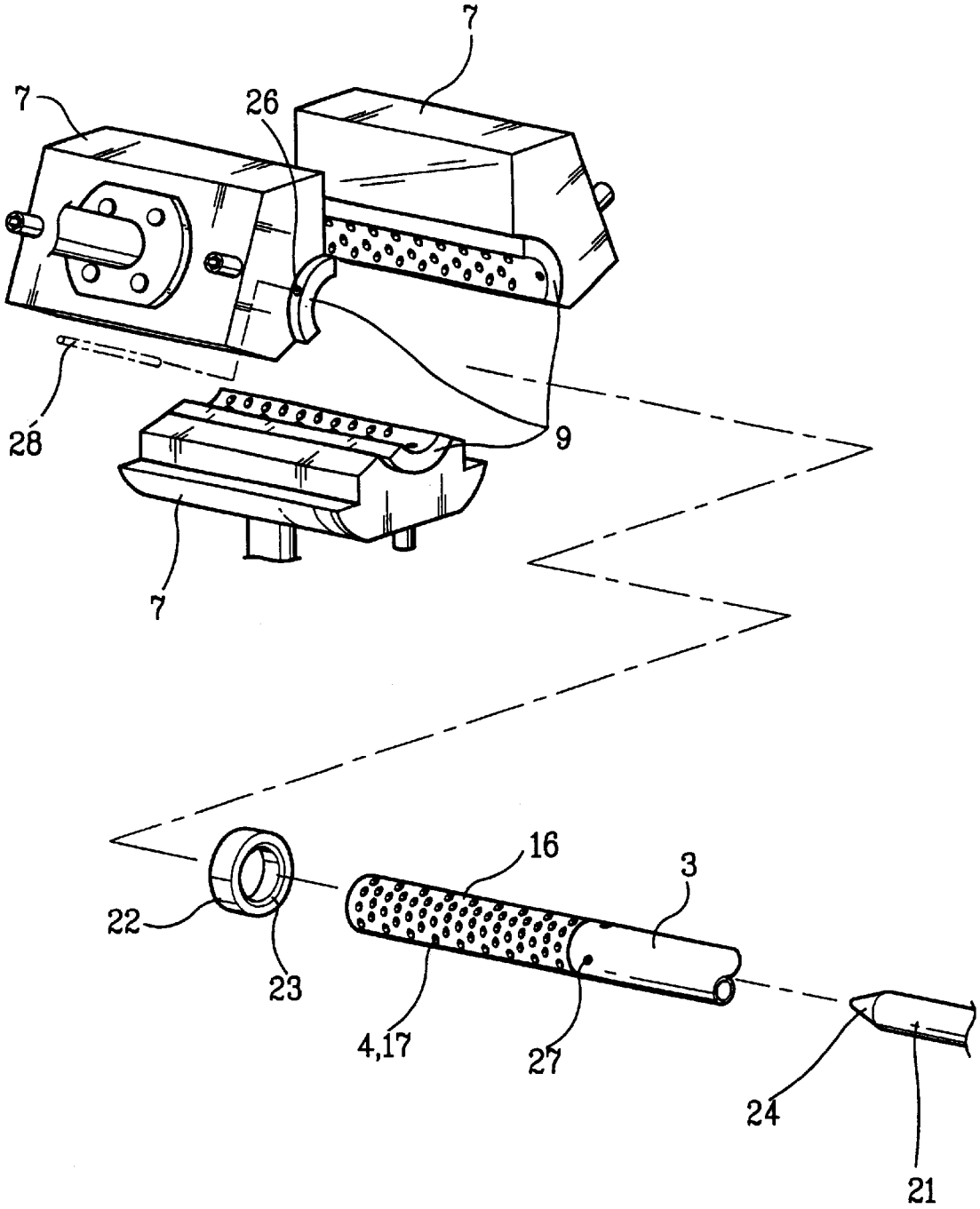
FIG. 3 illustrates a disassembled perspective view showing key parts of a device for embossing metal pipe in accordance with a preferred embodiment of the present invention.
Figure 4A:
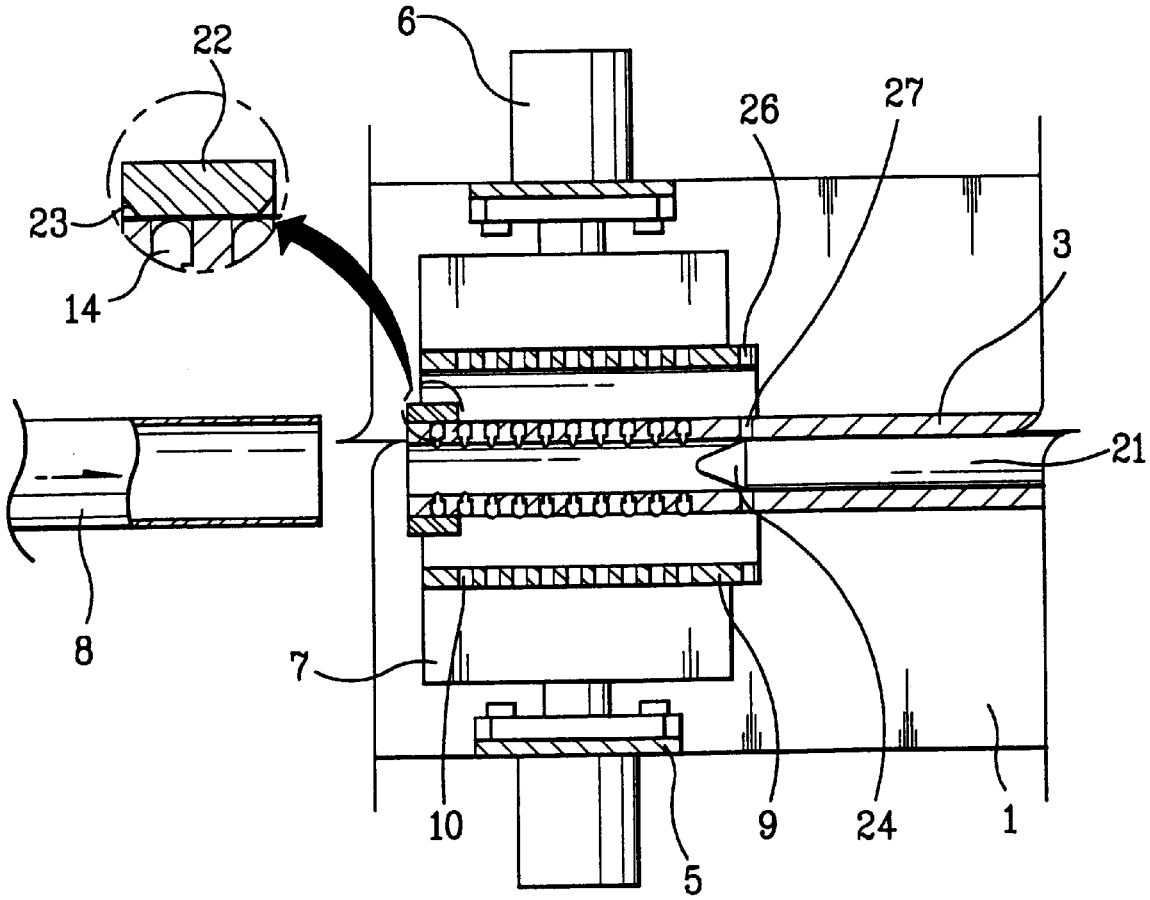
FIG. 4A illustrates a section of key parts of a device for embossing metal pipe in accordance with a preferred embodiment of the present invention, for showing a state when a completed metal pipe to be embossed is ready to be inserted into a core.
Figure 4B:
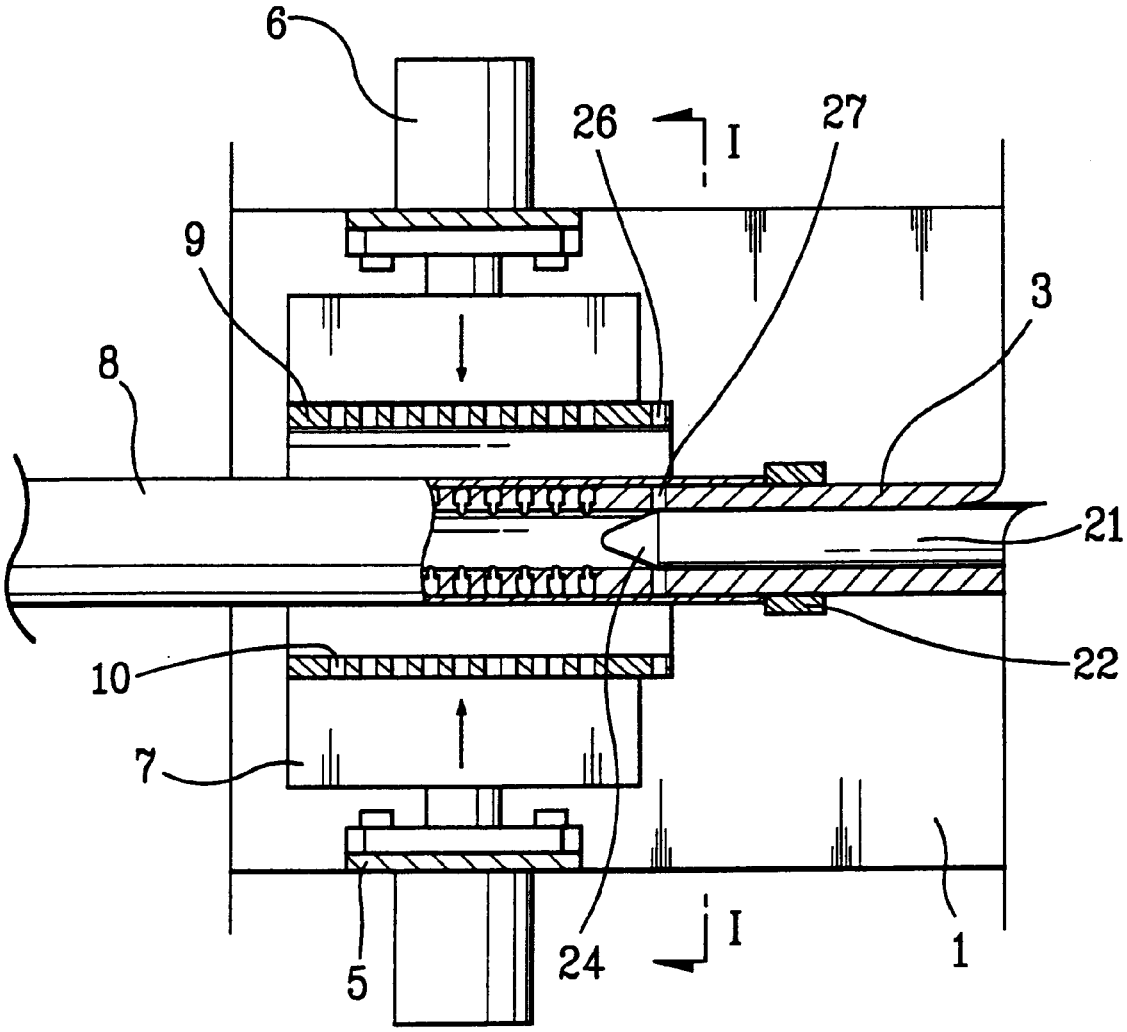
FIG. 4B illustrates a section of key parts of a device for embossing metal pipe in accordance with a preferred embodiment of the present invention, for showing a state when a completed metal pipe to be embossed is being inserted onto a core.
Figure 4C:
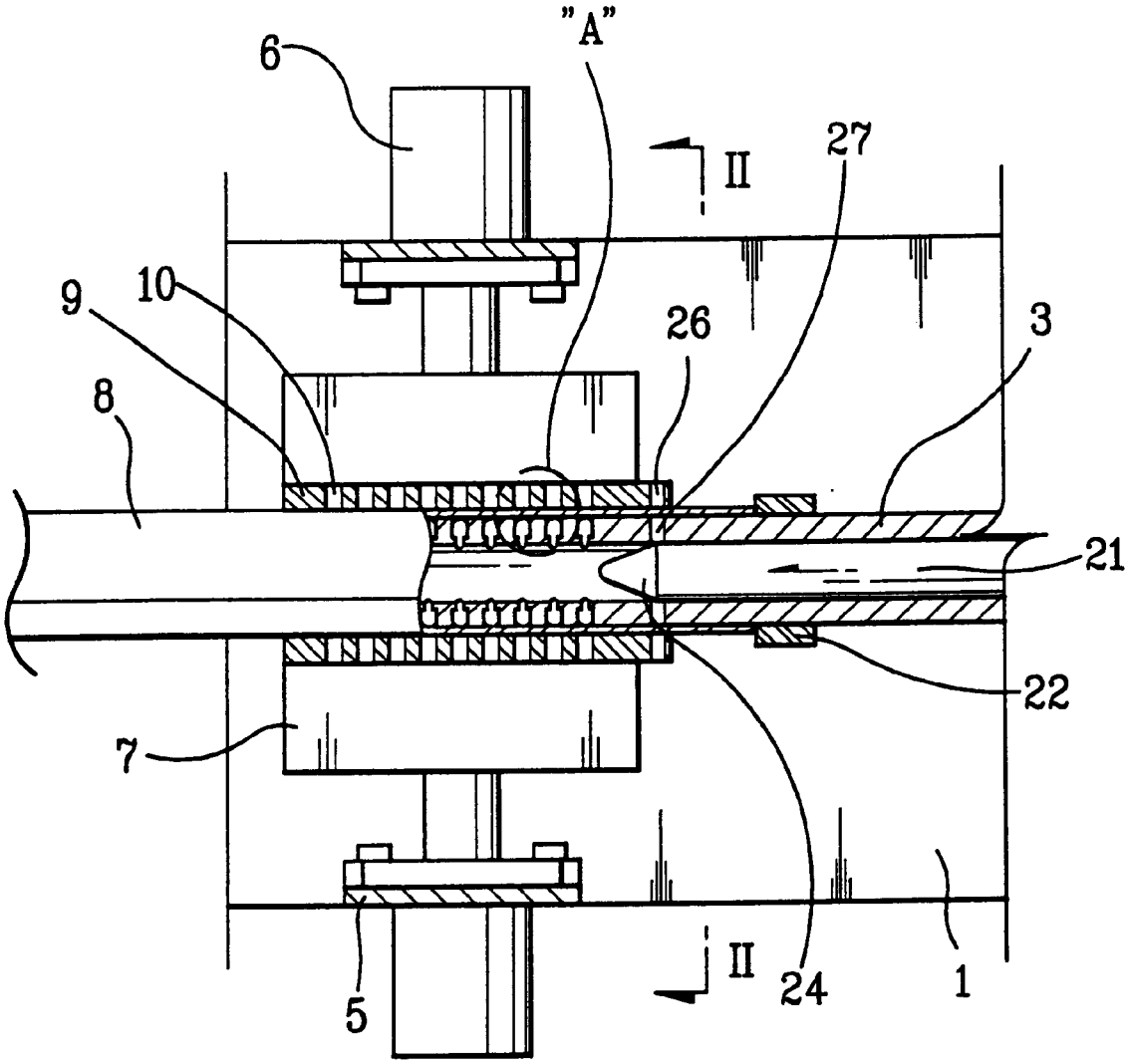
FIG. 4C illustrates a section of key parts of a device for embossing metal pipe in accordance with a preferred embodiment of the present invention, for showing a state when a completed metal pipe to be embossed is inserted on a core, and surrounded and gripped by a plurality of casings, an outer metal mold.
Figure 4D:
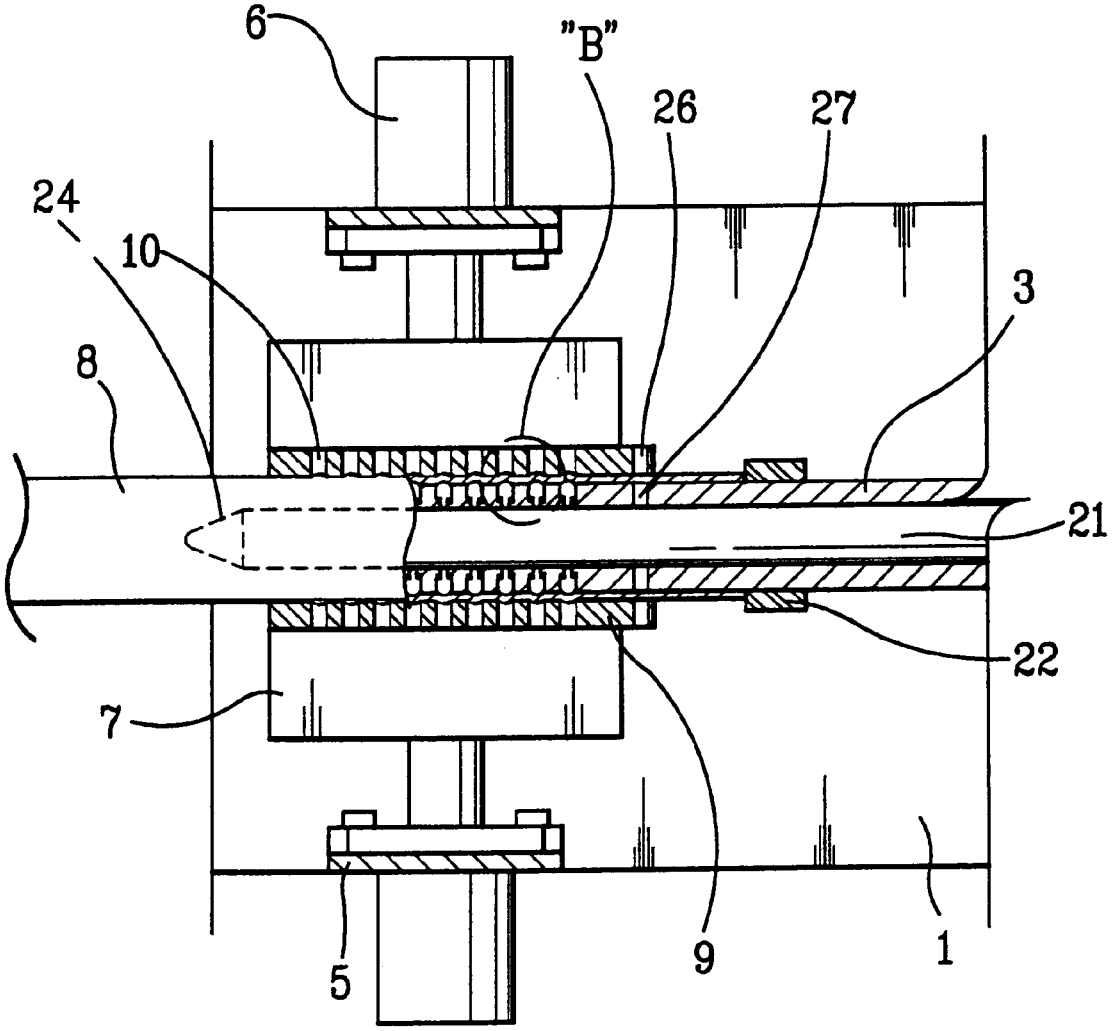
FIG. 4D illustrates a section of key parts of a device for embossing metal pipe in accordance with a preferred embodiment of the present invention, for showing a state when a plunger is inserted into a plunger hole in a core, to form embossing on metal pipe.
Figure 5:
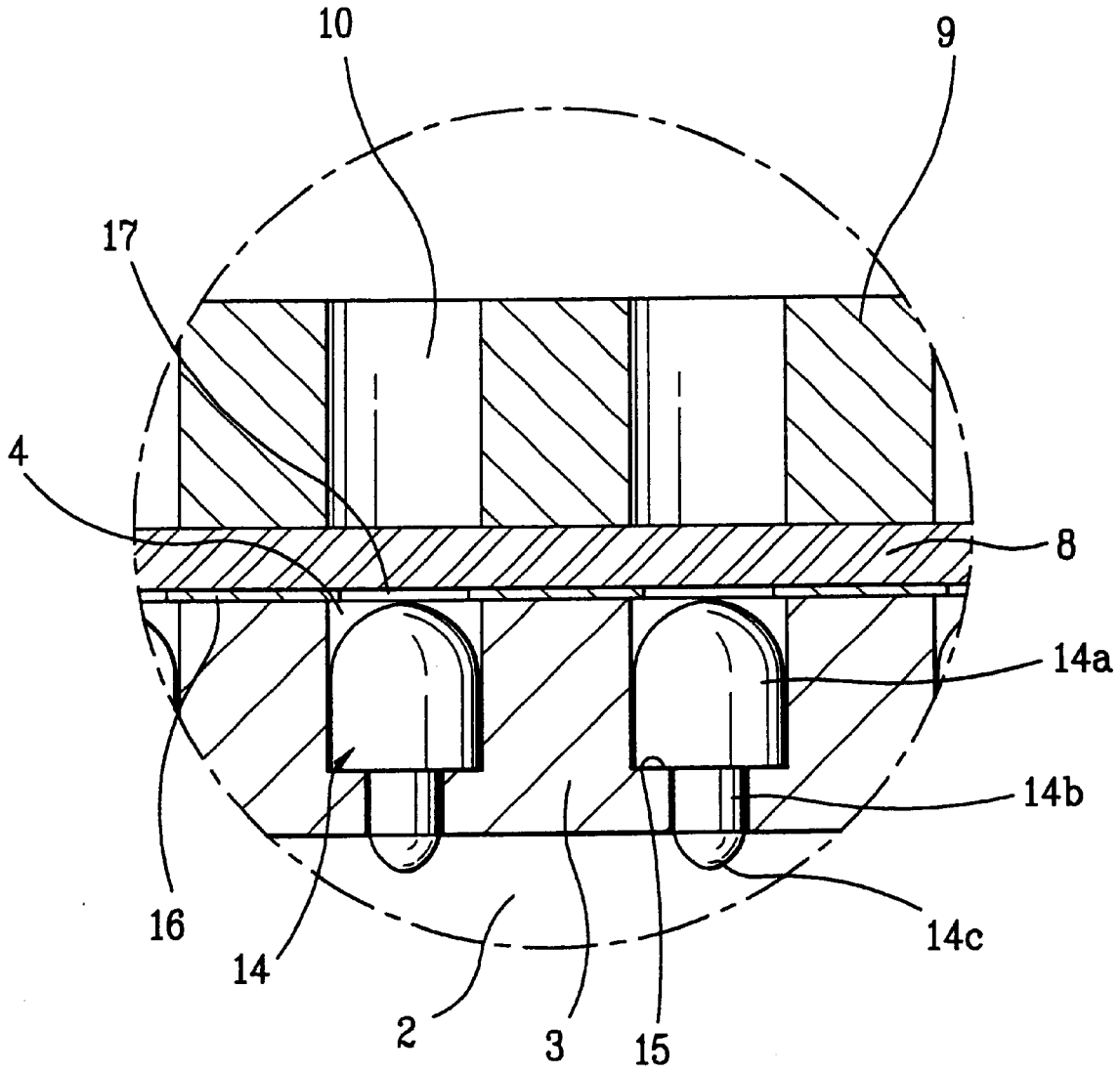
FIG. 5 illustrates an enlarged view of "A" part in FIG. 4C showing a state when punches in through holes in the core are ready to emboss metal pipe.
Figure 6:
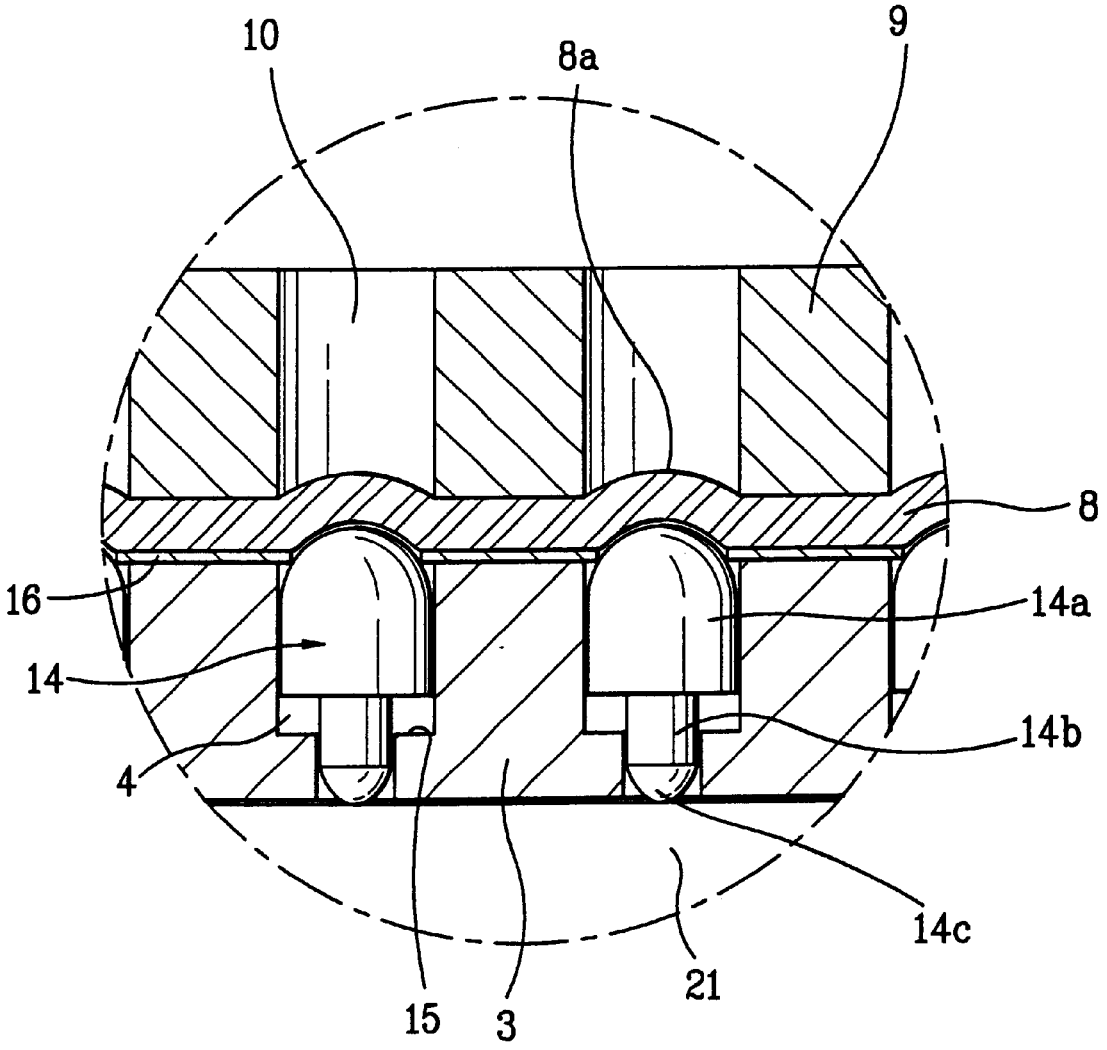
FIG. 6 illustrates an enlarged view of "B" part in FIG. 4D showing a state when punches in through holes in the core emboss metal pipe.
Figure 7:
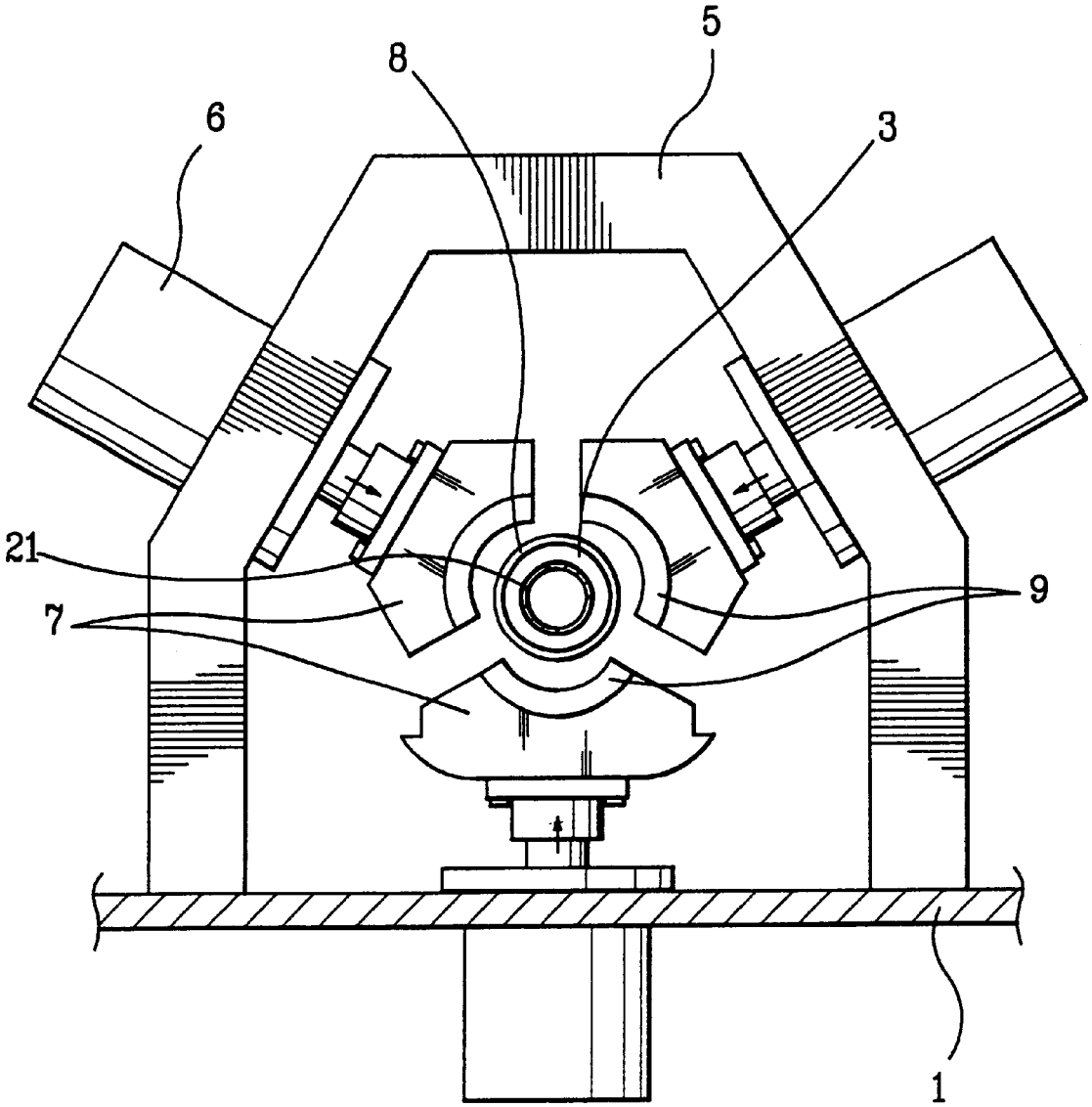
FIG. 7 illustrates a section across line I—I in FIG. 4B.
Figure 8:
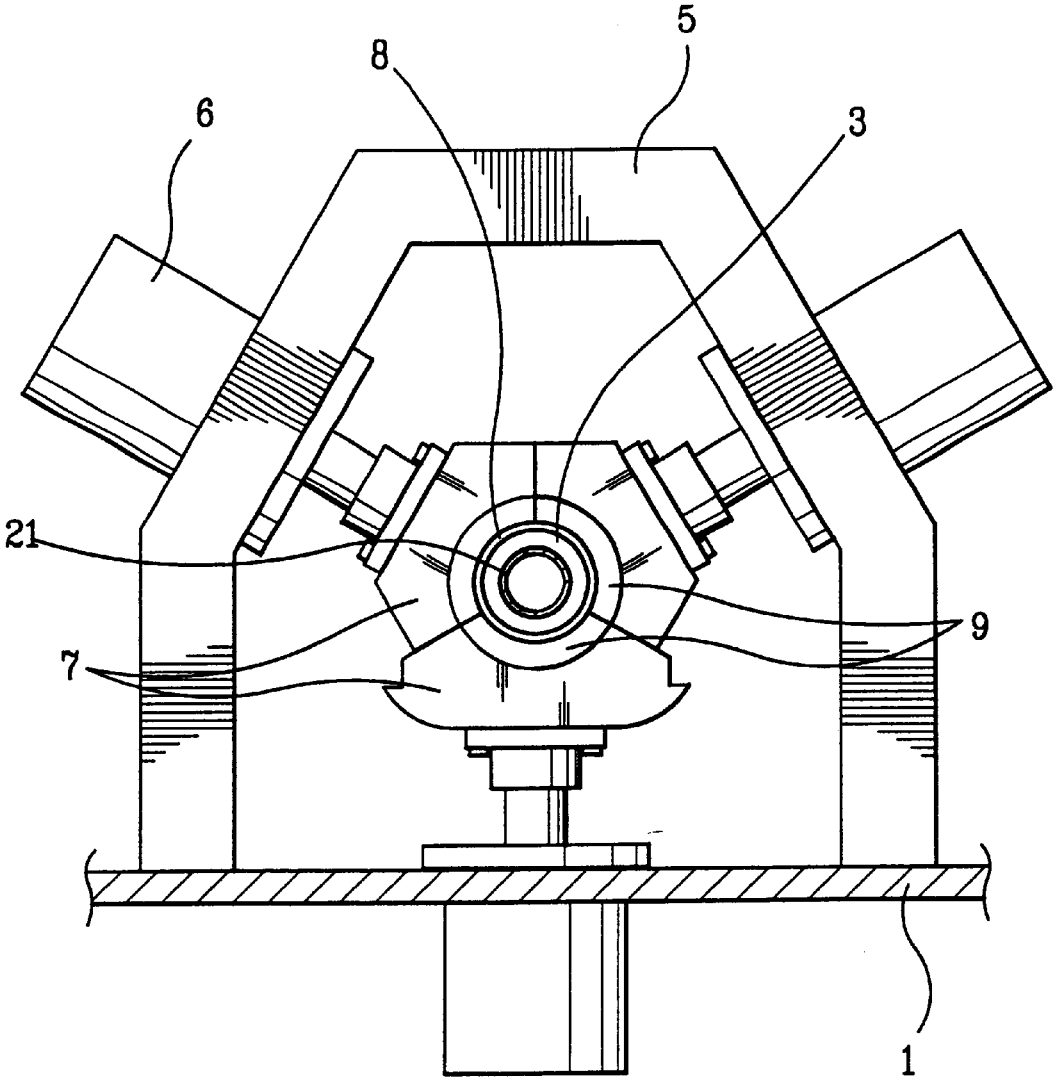
FIG. 8 illustrates a section across line II—II in FIG. 4C.
Figure 9:
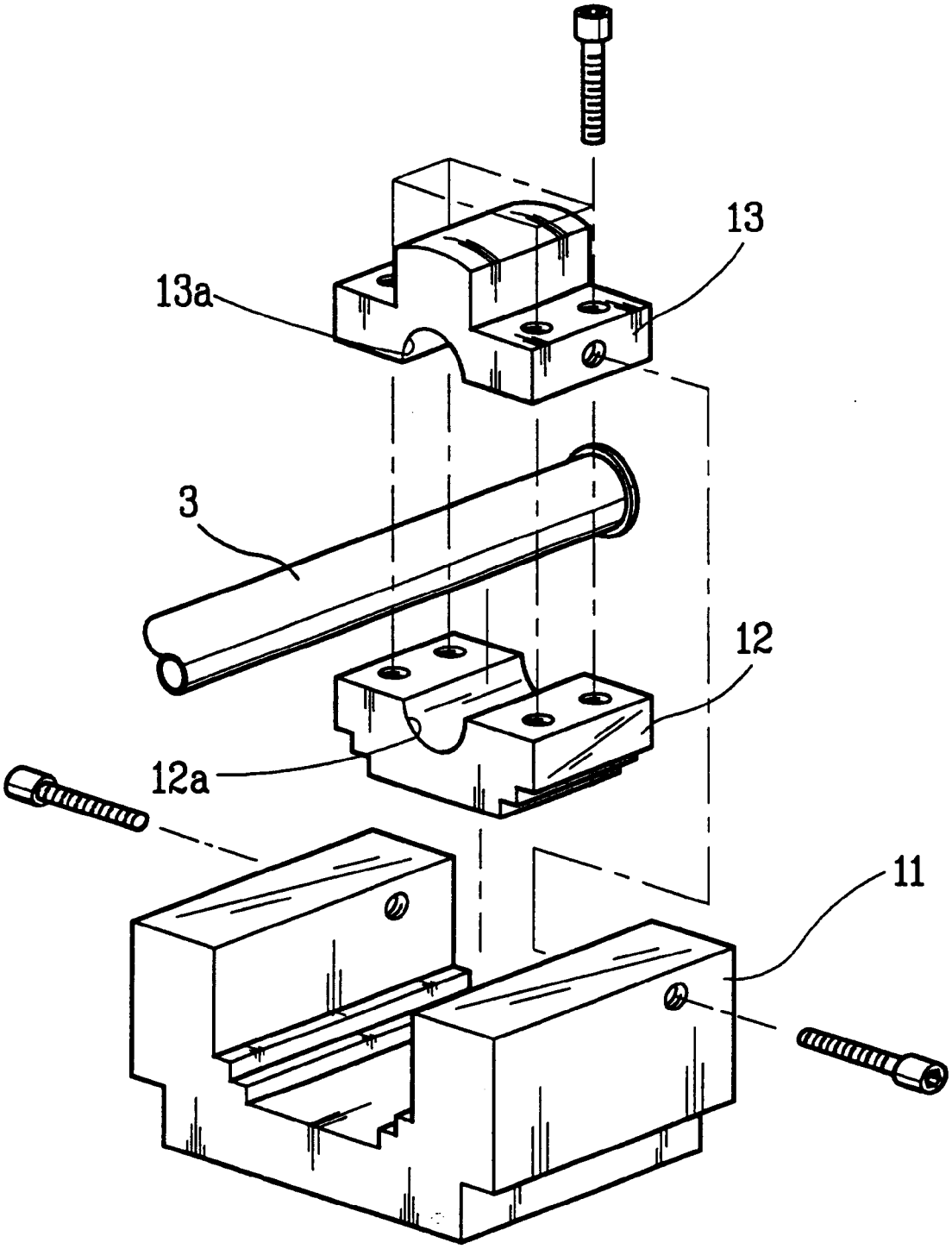
FIG. 9 illustrates a disassembled perspective view of core holder of the present invention; and, FIG. 10 illustrates a perspective view of embossed metal pipe of the present invention.
Figure 10:
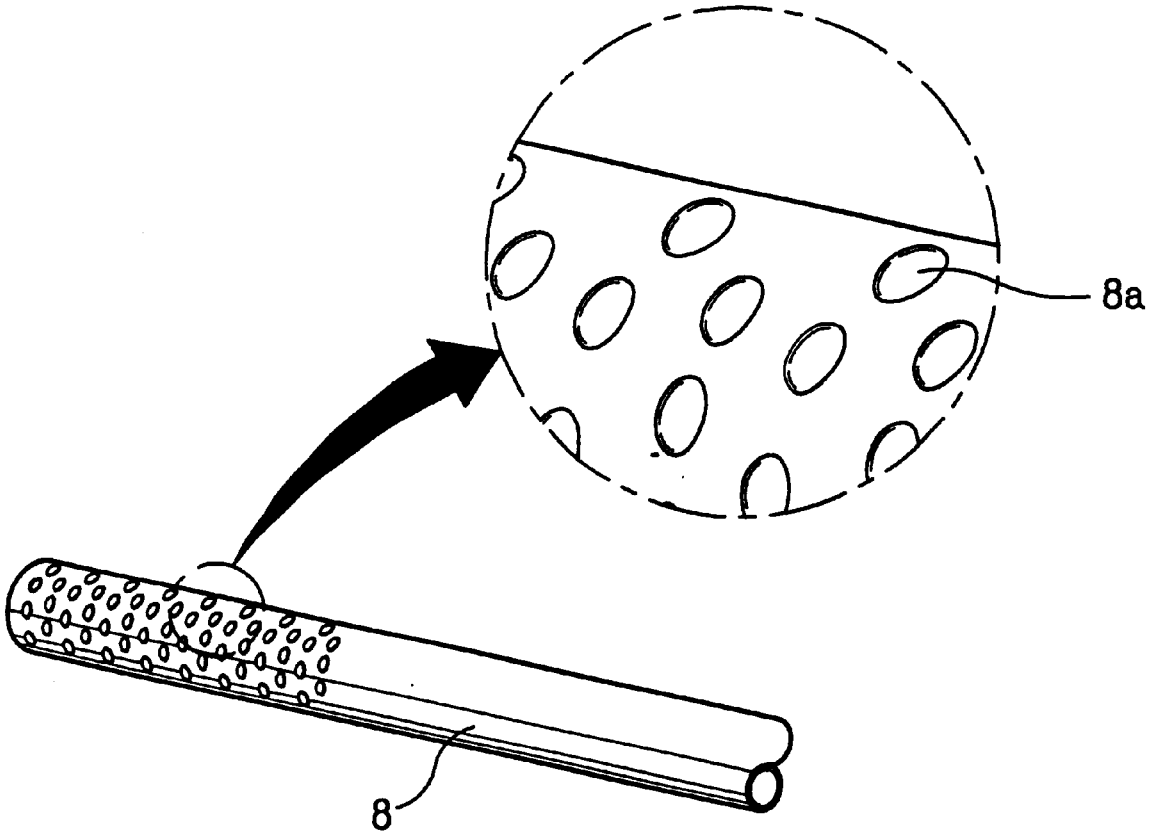

Reference will now be made in detail to the preferred embodiments of the present invention, examples of which are illustrated in the accompanying drawings. FIG. 1 illustrates a perspective view of a device for embossing metal pipe in accordance with a preferred embodiment of the present invention, FIG. 2 illustrates a plan view of a device for embossing metal pipe in accordance with a preferred embodiment of-the present invention, FIG. 3 illustrates a disassembled perspective view showing key parts of a device for embossing metal pipe in accordance with a preferred embodiment of the present invention, FIG. 4A illustrates a section of key parts of a device for embossing metal pipe in accordance with a preferred embodiment of the present invention, for showing a state when a completed metal pipe to be embossed is ready to be inserted into a core, FIG. 4B illustrates a section of key parts of a device for embossing metal pipe in accordance with a preferred embodiment of the present invention, for showing a state when a completed metal pipe to be embossed is being inserted onto a core, FIG. 4C illustrates a section of key parts of a device for embossing metal pipe in accordance with a preferred embodiment of the present invention, for showing a state when a completed metal pipe to be embossed is inserted on a core, and surrounded and gripped by a plurality of casings, an outer metal mold, FIG. 4D illustrates a section of key parts of a device for embossing metal pipe in accordance with a preferred embodiment of the present invention, for showing a state when a plunger is inserted into a hole in a core, to form embossing on metal pipe, FIG. 5 illustrates an enlarged view of "A" part in FIG. 4C showing a state when punches in through holes in the core are ready to emboss metal pipe, FIG. 6 illustrates an enlarged view of "B" part in FIG. 4D showing a state when punches in through holes in the core emboss metal pipe, FIG. 7 illustrates a section across line I—I in FIG. 4B, FIG. 8 illustrates a section across line II—II in FIG. 4C, FIG. 9 illustrates a disassembled perspective view of core holder of the present invention, and FIG. 10 illustrates a perspective view of embossed metal pipe of the present invention.

The device for embossing metal pipe includes a frame 1 supported on ground, a length of core 3 having one end detachably fixed horizontally in an upper surface of the frame 1, having a plunger hole 2 at a center thereof in an axis direction and a plurality of core pass through holes 4 perpendicular to the plunger hole 2 in a portion of the core 3, a first stock 5 on one side of the upper surface of the frame 1 around the core 3, first reciprocating members 6 in the first stock and the frame 1 each for reciprocating perpendicular to the axis of the core 3, first segments 7 respectively fitted to the first reciprocating members 6 to surround the core pass through holes 4 in the core 3 for moving along the movement of the first reciprocating members 6, casings 9 detachably fitted to the segments 7 by screws respectively to move with the segments 7 for serving as an outer mold in selectively forming embossing projections 8*a* on a circumferential surface of the metal pipe 8. The casing 9 has a plurality of casing pass through holes 10 opposite to the core pass through holes 4 in the core 3. As the core 3 is required to be changed with another core according to a diameter of the metal pipe 8 the embossing projections 8*a* are to be formed thereon, one end of the core 3 is detachably fixed to an upper surface of the frame 3, by mounting a core holder 11 on the upper surface of the frame 3, a lower gripper 12 fixed to the core holder by screw having a lower recess 12*a* fit to a diameter of the core 3 to be used, an upper gripper 13 fixed to the lower gripper by screw having an upper recess 13*a* fit to the diameter of the core 3 to be used, to grip one end of the core 3 between the lower gripper 12 and the upper gripper 13. A punch 14 is movably inserted in each of the core pass through holes 4 in the core 3 for selectively and forcibly moving outwardly perpendicular to the core axis 3 by a force applied thereto, to form embossing projections 8*a* on the metal pipe 8 inserted on the core 3. The punch 14 is kept in position inside of the core pass through hole 4 by punch fall off preventing means, without falling off inward or outward direction, always. A fore end of the punch 14 may have a particular form, such as semi-spherical, conical, or triangular pyramid form depending on a form of the embossing projection 8*a* intended to form on the metal pipe. The punch fall off preventing means includes a large diametered part 14*a* of the punch 14 forming an outside portion of the punch 14, a small diametered part 14*b* forming an inside portion of the punch 14 smaller than the large diametered part 14*a,* a step 15 in the core pass through hole 4 close to the plunger hole 2 for blocking the large diametered part 14*a* of the punch 14, a thin cover pipe 16 fitted tightly around the core 3 having cover pipe pass through holes 17 each opposite to the core pass through hole 4 with a diameter slightly smaller than the diameter of the core pass through hole 4 for passing the fore end of the large diametered part 14*a* of the punch 14 only. As the cover pipe 16 is provided for preventing the punch 14 from falling off the core pass through hole 4, the cover pipe 16 may be dispensed with as far as there is a device that can prevent the punch 14 from falling off the core pass through hole 4. There is a second stock 18 mounted on the other side of the upper surface of the frame 1, a second reciprocating member 19 in the axis direction of the core 3 in the second stock 18, a second segment 20 fitted inside of the second reciprocating member for moving along the movement of the second reciprocating member 19, a plunger 21 fixed to the second segment 20 for moving along the movement of the second segment 20 through the plunger hole 2 to push the punches 14 in the core pass through holes 4 selectively away in a direction perpendicular to the axis of the core 3, and a sliding ring 33 inserted on the core 3 for sliding on the core 3 with tapered surfaces 23 in opposite ends of inside circumference thereof for preventing the sliding ring 33 from interfering with the punches 14 in the core pass through holes 4 when the sliding ring 22 moves along the core 3. The plunger 21 has a plunger sloped surface 24 to form a sharp end at an opposite end of the plunger 21 fixed to the second stock 20, and the small diametered part 14*b* of the punch 14 has a smoothly rounded curved portion 14*c,* so that the plunger 21 moving perpendicular to the punches 14 comes into smooth contact with the punches 14. The first reciprocating members 6 and the second reciprocating member 19 may be hydraulic cylinders, pneumatic cylinders, or ball screws driven by motors, and the embodiment of the present invention employs the hydraulic cylinders.

Though the embodiment of the present invention shows the core 3, the casing 9 selectively covering the core 3, the plunger 21 moving along the plunger hole 2 in the core 3, all of which are cylindrical, for embossing cylindrical metal pipe 8, the form is not limited to the cylindrical form, but the foregoing components may be, not the cylindrical, but polygonal, for embossing polygonal metal pipe.

It can be known that the hydraulic cylinders of the first reciprocating members 6, and the second reciprocating member 19 are controlled by a controller 25 fitted to an appropriate place of the frame 1.

The operation of the device for embossing metal pipe of the present invention will be explained.

Referring to FIG. 4A, at an initial state of operation of the device for embossing the metal pipe 8, the casings 9 fitted to the segments 7 are disposed away from the core 3 in the direction perpendicular to the axis of the core 3, the core 3 is disposed such that a fore end of the core 3 the other end of which is fastened to the second segment 20 is at a farthest position from the second stock 18 in the first stock 5 direction, and the sliding ring 22 is on the fore end of the core 3. As the core 3 is horizontal, the punch 14 in the core hole 4 rests at a possible lowest position. Since the punch 14 has the outward large diametered part 14*a* and the inward small diametered part 14*b,* the step 15 in the core hole 4 is formed close to the plunger hole 2 for stopping the large diametered part 14*a* of the punch 14, the thin cover pipe 16 is inserted on the core 3 tightly, and the cover pipe pass through hole 17 has a diameter slightly smaller than the diameter of the core pass through hole 4, the punches 14 in the core pass through holes 4 in an upper portion of the core 3 are stopped at the steps 15, and the punches 14 in the core pass through holes 4 in a lower portion of the core 3 are stopped at the steps 15. Since the cover pipe 16 is provided for preventing the punches 14 from falling off the core pass through holes 4, the cover pipe 16 is not necessarily required if there is an alternative means for preventing the punches 14 from falling off the core pass through holes 4. For preventing the punches 14 from falling off the core pass through holes 4, instead of covering the core 3 with the cover pipe 16, an outer circumference of the core pass through hole 4 may be slightly pressed toward center, to reduce a diameter of the portion, slightly. As shown in FIG. 4A, in the initial state, the sliding ring, 22 is required to be positioned on the fore end of the core 3, for preventing a fore end of the metal pipe 8 from coming into interfere with the punches 14 at right angles to the punches 14 in any case when the embossing projections 8*a* are formed in a later process as the sliding ring 22 is pushed by the metal pipe 8 when the metal pipe 8 is inserted into the core 3. Upon inserting the metal pipe 8 into the core 3 by applying a force by hands or a separate device in a state the sliding ring 22 is on the fore end of the core 3, as the metal pipe 8 is inserted into the core 3 as shown in FIG. 4B, while the metal pipe 8 pushes the sliding ring 22, and, in a state the metal pipe 8 is inserted into the core 3, the punches 14 in the core pass through holes 4 are covered by the metal pipe 8. When the sliding ring 22 is slid to the fore end of the core 3 before the metal pipe 8 is inserted into the core 3, or slid toward the second stock 18 by the metal pipe 8 from the fore end of the core 3, the punches 14 come into contact with the sliding ring 22 are pushed inside toward the plunger hole 2 in the core 3 smoothly as the tapered surface 23 of the sliding ring 22 comes into contact with the large diametered part 14*a* of the punch 14, smoothly. Though the sliding ring 22 is not necessarily required, the sliding ring 22 makes smooth insertion of the metal pipe 8 into the core 3 without interference with the punches 14 at right angles.

Upon selection of one operation button on the controller 25 for operating the first reciprocating members 6 in the state the metal pipe 8 is inserted on the core 3, the first reciprocating members 6, hydraulic cylinders, respectively fixed to the first stock 5 and the frame 1 for reciprocating in a direction perpendicular to the axis of the core 3 come into operation, to move the first segments 7 inward to the core 3, until the casings 9 fitted to insides of the first segments 7 come to grip a portion of the metal pipe 8 on the core 3 entirely where the core pass through holes 4 are formed at a preset pressure as shown in FIG. 4C, positioning the metal pipe 8 the embossing projections 8*a* are to be formed thereon between the core 3 and the first segments 7. In a state shown in FIG. 4C, the punches 14 are pushed inward by the metal pipe 8 toward the plunger hole 2 in the core 3, to project all the curved parts 14*c,* a small diametered parts 14*b* of the punches 14, into the plunger hole 2 as shown in FIG. 5.

Then, upon selection of an operation button for the second reciprocating member 19, the second reciprocating member 19, a hydraulic cylinder, fixed to the second stock 18 comes into operation, to push the second segment 20 fitted to an inside of the second stock 18 toward the core 3, when the plunger 21 fitted to the second segment 20 is pushed toward the first stock 5 along the core pass through hole 4, during which the plunger 21 comes into contact with ends of the small diametered parts of the punches 14, to push the punches 14 outward in a direction perpendicular to the axis of the core 3 as shown in FIG. 4D, to press the metal pipe 8 outward as, not entire portions, but end portions of the large diametered portion 14*a* are projected from the core 3. According to this, since the casing pass through holes 11 in the casings 9 are formed opposite to the core pass through holes 4, the embossing projections 8*a* fit to the form of the end portions of the large diametered parts 14*a* are formed around the metal pipe 8, at the end. In the embodiment of the present invention, though the operator selects respective operation buttons on the controller 25 for operating the first reciprocating members 6 and the second reciprocating member 19, it is possible that the controller 25 operates automatically to operates the second reciprocating member 19 after the first reciprocating members 6 are operated as the case demands without the operator's intervention. Meanwhile, when the plunger 21 comes into contact with inner ends of the punches 14 in a course moving toward the first stock guided by the core pass through hole 4, the plunger 21 moves smoothly without stopping the movement owing to interference with the punches 14 as the plunger 21 has the plunger sloped surface 24 and the inner end, the small diametered part 14*b,* of the punch 14 has the smoothly rounded curved portion 14*c*.

After formation of the embossing projections 8*a* on the metal pipe 8 in the aforementioned device of the present invention, the embossed metal pipe 8 is taken out of the core 3 by a reversed process of the foregoing process.

When it is required to emboss new metal pipe with a diameter different from the diameter of the metal pipe 8 embossed up to now, the core 3, the casings 9, and the plunger 21 are required to be replaced with ones having sizes fit to the diameter of the new metal pipe. The core 3 can be replaced with a new one by disassembling the lower gripper 12 from the core holder 11 and the upper gripper 13 from the lower gripper 12, and selecting and screwing a new lower gripper 12 having a lower recess 12*a* fit to a diameter of the core 3 to be used to the core holder 11 and a new upper gripper 13 having an upper recess 13*a* fit to a diameter of the core 3 to be used to the new lower gripper 12 with a new core 3 provided between the new upper gripper 12 and the new upper gripper 13. It is preferable that the sloped surface portion 24 of the plunger is formed of a permanent magnet, for attracting the punches 14 inward toward the plunger hole 2 in the core 3 by a magnetic force when the plunger 21 is retracted toward the second stock 18, so that the metal pipe 8 is not caught by the punches 14 when the embossed metal pipe 8 is drawn out of the core 3.

Since it is required to align the core pass through holes 4 in the core 3 with the casing holes 10 in the casings 9 exactly, a method is suggested for meeting this requirement, in which a portion of each of the casings 9 is extended out of the first segments 7, in which an outer positioning hole 26 is formed, inner positioning holes 27 are formed in the core 3 at positions opposite to respective outer positioning holes 26 in the casings 9, and a dowel pin 28 is inserted through the outer and inner positioning holes 26 and 27 before fastening the core 3 and the casing 9.

As has been explained, the device for embossing metal pipe of the present invention has the following advantages.

The availability of a variety of embossing on metal pipe provides wide application of the embossed pipe, such as steps in structures, various handrails, and frames, which have effects of slip prevention, and a variety of designs.

It will be apparent to those skilled in the art that various modifications and variations can be made in the device for embossing metal pipe of the present invention without departing from the spirit or scope of the invention. Thus, it is intended that the present invention covers the modifications and variations of the invention provided they come within the scope of the appended claims and their equivalents.

What is claimed is:

1. A device for embossing metal pipe comprising:

a frame supported on ground;

a length of core having one end detachably fixed horizontally to an upper surface of the frame having a plunger hole at a center thereof in an axis direction and a plurality of core pass through holes perpendicular to the plunger hole in a portion of the core;

a first stock fixed to one side of the upper surface of the frame;

first reciprocating members fixed in the first stock and the frame each for reciprocating perpendicular to the axis of the core;

first segments respectively fitted to insides of the first reciprocating members for moving along the movement of the first reciprocating members;

casings detachably and respectively fitted to the segments for coming into a close contact with the core as the casings move inward or moving away from the core as the casings move outward, having a plurality of casing pass through holes in an inside surface thereof opposite to the core pass through holes;

a punch movably inserted in each of the core pass through holes for selectively and forcibly moving outwardly perpendicular to the core axis, to form embossing projections on the metal pipe inserted on the core;

punch fall off preventing means for keeping the punch in position inside of the core pass through hole without falling off inward or outward direction including a large diametered part of the punch forming an outside portion of the punch, a small diametered part forming an inside portion of the punch smaller than the large diametered part, a step in the core pass through hole close to the plunger hole for blocking the large diametered part of the punch, and a thin cover pipe fitted tightly around the core having cover pipe pass through holes each opposite to the core pass through hole with a diameter slightly smaller than the diameter of the core pass through hole for passing the fore end of the large diametered part of the punch only;

a second stock mounted on the upper surface of the frame and spaced apart from the first stock with a predetermined distance;

a second reciprocating member fixed to the second stock for reciprocating in the axis direction of the core;

a second segment fitted an inside of the second reciprocating member for moving along the movement of the second reciprocating member; and, a plunger detachably fixed to the second segment for moving along the movement of the second segment through the plunger hole to push the punches in the core pass through holes selectively away in a direction perpendicular to the axis of the core.

2. A device as claimed in claim 1, further comprising a core holder on the upper surface of the frame including;

a lower gripper fixed to the core holder by screw having a lower recess fit to a diameter of the core to be used, an upper gripper fixed to the lower gripper by screw having an upper recess fit to the diameter of the core to be used, thereby gripping one end of the core between the lower gripper and the upper gripper.

3. A device as claimed in claim 1, wherein a fore end of the large diametered part that is an outer portion of the punch has a form selected from semi-sphere, cone, and triangular pyramid, and star.

4. A device as claimed in claim 1, wherein the first reciprocating members and the second reciprocating member are any ones selected from hydraulic cylinders, pneumatic cylinders, ball screws.

5. A device as claimed in claim 1, wherein the plunger includes a fore end formed to have a sloped surface, and the small diametered part of the punch includes a smoothly rounded curved portion for preventing the plunger from interfering with the punches in a course moving toward the one side for pressing the punches.

6. A device as claimed in claim 5, wherein the punch is formed of a magnetic material, and the sloped surface of the plunger is formed of permanent magnet.

7. A device as claimed in claim 1, further comprising a sliding ring inserted on the core having tapered surfaces on an inner circumference of both sides thereof.

8. A device as claimed in claim 1, further comprising an outer positioning hole in a portion of each of the casings extended out of the first segments, inner positioning holes formed in the core at positions opposite to respective outer positioning holes in the casings, and a dowel pin for inserting through each pair of the outer and inner positioning holes before fastening the core and the casings, thereby respectively aligning the core pass through holes and the casing pass through holes, exactly.

* * * * *